US008925321B2

(12) United States Patent
Leu et al.

(10) Patent No.: US 8,925,321 B2
(45) Date of Patent: Jan. 6, 2015

(54) STEAM POWER PLANT FOR GENERATING ELECTRICAL ENERGY

(75) Inventors: Bernd Leu, Meerbusch (DE); Andreas Logar, Hattingen (DE); Heinz Lötters, Kamp-Lintfort (DE); Stephan Minuth, Mülheim a.d. Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 803 days.

(21) Appl. No.: 13/119,438

(22) PCT Filed: Sep. 16, 2009

(86) PCT No.: PCT/EP2009/061993

§ 371 (c)(1), (2), (4) Date: Mar. 17, 2011

(87) PCT Pub. No.: WO2010/034659

PCT Pub. Date: Apr. 1, 2010

(65) Prior Publication Data

US 2011/0167827 A1 Jul. 14, 2011

(30) Foreign Application Priority Data

Sep. 24, 2008 (EP) ..... 08016801

(51) Int. Cl.

| | |
|---|---|
| ***F01K 7/22*** | (2006.01) |
| ***F01K 7/34*** | (2006.01) |
| ***F01K 7/16*** | (2006.01) |
| ***F01K 13/02*** | (2006.01) |

(52) U.S. Cl.

CPC ..... *F01K 7/165* (2013.01); *F01K 13/02* (2013.01); *F01K 13/025* (2013.01)

USPC ..... 60/679; 60/653

(58) Field of Classification Search

USPC ..... 60/645–681

See application file for complete search history.

(56) References Cited

U.S. PATENT DOCUMENTS

| | | | | | |
|---|---|---|---|---|---|
| 3,277,651 | A | * | 10/1966 | Augsburger | 60/657 |
| 4,352,270 | A | * | 10/1982 | Silvestri, Jr. | 60/648 |
| 4,357,803 | A | * | 11/1982 | Dickenson | 60/662 |
| 4,576,008 | A | * | 3/1986 | Silvestri, Jr. | 60/662 |
| 4,598,551 | A | * | 7/1986 | Dimitroff et al. | 60/646 |
| 4,873,827 | A | * | 10/1989 | Hadano et al. | 60/646 |
| 5,477,683 | A | * | 12/1995 | Persson | 60/653 |
| 6,457,313 | B1 | | 10/2002 | Fujii | |
| 6,647,727 | B2 | * | 11/2003 | Klatt et al. | 60/653 |

FOREIGN PATENT DOCUMENTS

| | | | |
|---|---|---|---|
| DE | 10227709 | A1 | 2/2003 |
| EP | 1862647 | A1 | 12/2007 |
| EP | 1881164 | A1 | 1/2008 |
| JP | 58012604 | A | 1/1983 |
| JP | 58091309 | A | 5/1983 |
| JP | 60228710 | A | 11/1985 |
| JP | 61093208 | A | 5/1986 |
| JP | 8014009 | A | 1/1996 |
| JP | 2002341947 | A | 11/2002 |
| RU | 2090542 | C1 | 9/1997 |
| SU | 642493 | A1 | 1/1979 |

* cited by examiner

*Primary Examiner* — Christopher Jetton

(57) ABSTRACT

A steam power plant is provided. The steam power plant includes a bypass pipeline which connects the fresh steam line flow to the exhaust steam line, wherein a bypass steam cooler is disposed in the bypass pipeline. In the event of an emergency stop, or a startup, or a shutdown, the bypass steam cooler cools the steam flowing into the bypass pipeline, whereby cheaper materials may be used for the bypass pipeline.

9 Claims, 2 Drawing Sheets

STEAM POWER PLANT FOR GENERATING ELECTRICAL ENERGY

CROSS REFERENCE TO RELATED APPLICATIONS

This application is the US National Stage of International Application No. PCT/EP2009/061993, filed Sep. 16, 2009 and claims the benefit thereof. The International Application claims the benefits of European Patent Office application No. 08016801.6 EP filed Sep. 24, 2008. All of the applications are incorporated by reference herein in their entirety.

FIELD OF INVENTION

The invention relates to a steam power plant for generating electrical energy, comprising a steam turbine, a steam generator and a condenser, and also a live steam pipeline which fluidically interconnects the steam turbine with the steam generator, an exhaust steam pipeline which fluidically interconnects the steam turbine with the condenser, and a bypass pipeline which fluidically interconnects the live steam pipeline with the exhaust steam pipeline.

BACKGROUND OF INVENTION

In a steam power plant, heat energy is converted into mechanical energy and ultimately into electrical energy, wherein water steam from the steam generator flows into an expansion machine, such as a steam turbine, wherein the steam is expanded in the steam turbine, with output of work. The steam which flows from the steam turbine is liquefied again in a downstream condenser as a result of heat absorption. The water which is produced in the condenser is delivered again to the steam generator by a feedwater pump, as a result of which a closed circuit is created.

In the operating state, the steam which flows from the steam generator flows into the steam turbine and cools down in the process, wherein the steam pressure reduces. The steam which flows from the steam turbine is fed again to the condenser. During starting, shutting down or in the case of an emergency shutdown of the steam turbine, a live steam valve arranged upstream of the steam turbine is closed and the live steam is directed via a bypass pipeline, wherein the bypass pipeline leads into an exhaust steam pipeline of the steam turbine. The exhaust steam pipeline as a rule is referred to as the cold reheat line if this leads into a reheater, in which the steam is heated to a higher temperature. The higher the steam temperatures are, the higher are the costs for the pipelines, bypass stations and the bypass steam injection to the condenser. Attempts are being undertaken to achieve steam temperatures of about 720° C. Such high temperatures require the use of special materials, such as nickel-based materials. Nickel-based materials are materials with a nickel content of about 40 to 50 per cent by weight. However, such nickel-based materials are comparatively expensive. On the other hand, a nickel-based material can thermally be especially loaded.

SUMMARY OF INVENTION

It would be desirable to be able to use materials which are more favorable than nickel-based materials. The invention starts at this point, the object of which is to disclose a steam power plant which is suitable for high temperatures and can be comparatively favorably designed.

This object is achieved by means of a steam power plant for generating electrical energy, comprising a steam turbine, a steam generator and a condenser, and also a live steam pipeline which fluidically interconnects the steam turbine with the steam generator, an exhaust steam pipeline which fluidically interconnects the steam turbine with the condenser, and a bypass pipeline which fluidically interconnects the live steam pipeline with the exhaust steam pipeline, wherein provision is made in the bypass pipeline for a bypass-steam cooler which is designed for cooling steam which can flow or is stationary in the bypass pipeline.

As a result of cooling the steam with the bypass-steam cooler, the components downstream of the cooling can be constructed without nickel-based materials. The pipeline which is arranged downstream of the bypass-steam cooler is therefore cooled, which leads to the bypass pipeline being less thermally stressed. As a result of the lower thermal stress, it is now no longer necessary to use expensive nickel-based materials.

If the exhaust steam pipeline leads into a reheater, this is referred to as a cold reheat line. In the reheater, steam is heated to a higher temperature.

Advantageous developments are disclosed in the dependent claims.

Therefore, it is advantageous if the cooling of the steam is carried out in the bypass-steam cooler by injecting cooling medium such as condensate, steam or a mixture of water and steam. The use of condensate, or a mixture of water and steam, is comparatively simple in a steam power plant since these cooling media are available in a steam power plant. The use of additional pipelines is consequently minimized.

The bypass-steam cooler is advantageously arranged directly downstream of a first branch from the live steam pipeline to the bypass pipeline. Ideally, the bypass-steam cooler should be arranged as close as possible to the first branch. This has the advantage that the costs for the production of the steam power plant can be further reduced because the use of expensive nickel-based material is avoided. The closer the bypass-steam cooler is located to the first branch from the live steam pipeline to the bypass pipeline, the less nickel-based material is required between the first branch and the bypass-steam cooler.

In a further advantageous development, the distance between the bypass-steam cooler and the high-pressure bypass valve is selected in such a way that the cooling medium is thoroughly mixed with the steam.

BRIEF DESCRIPTION OF THE DRAWINGS

A thorough mixing of the cooling medium with the steam leads to an efficient cooling of the bypass pipeline and consequently to a further reduction of the costs when producing the steam power plant since less nickel-based material can be used for the bypass pipeline. The invention is exemplarily explained in more detail with reference to the drawings.

In the drawing, partially schematized and not to scale.

Like designations have the same meaning in the various figures.

DETAILED DESCRIPTION OF INVENTION

Figure 1:
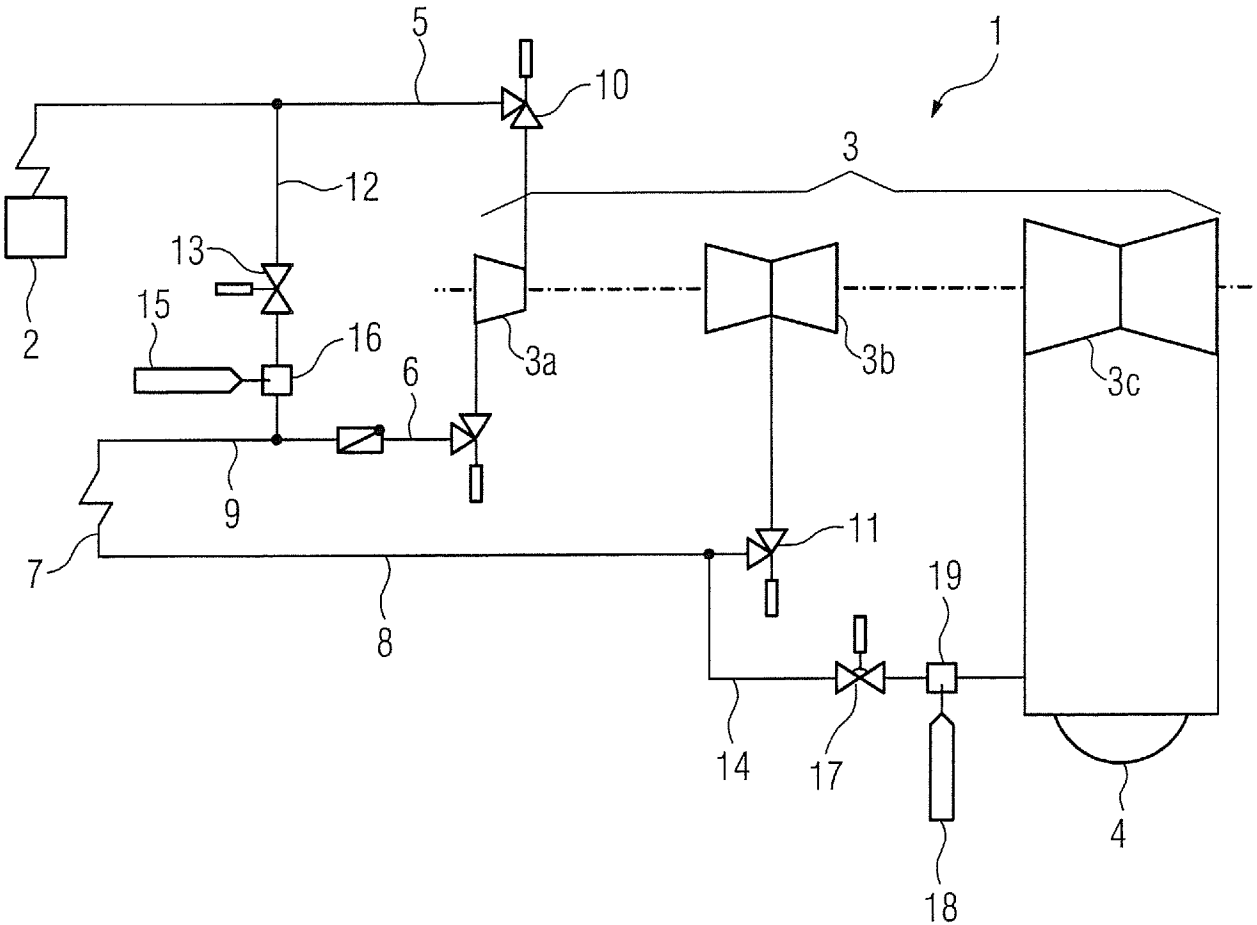
FIG 1 Prior art
FIG. 1 shows a steam power plant according to the prior art

FIG. 1 shows a steam power plant 1 according to the prior art. The steam power plant 1 comprises a steam generator 2, a steam turbine 3, wherein the steam turbine 3 comprises a high-pressure turbine section 3*a*, an intermediate-pressure turbine section 3*b* and a low-pressure turbine section 3*c*, and also a condenser 4. Furthermore, provision is made for a live steam pipeline 5 which fluidically interconnects the steam turbine 3 with the steam generator 2. An exhaust steam pipeline 6, which fluidically interconnects the steam turbine 3 with the condenser 4, is arranged downstream of the steam turbine 3. Between the high-pressure turbine section 3*a* and the condenser 4, provision is made for a reheater 7. The steam which flows into the reheater 7 is heated to a higher temperature and, via a hot reheat line 8, is directed to the intermediate-pressure turbine section 3*b*. The exhaust steam pipeline 6 may also be referred to as a cold reheat line 9. An emergency shut-off and control valve 10 is arranged upstream of the steam turbine 3. An emergency shut-off and control valve 11 is also arranged upstream of the intermediate-pressure turbine section 3*b*. The live steam pipeline 5 is fluidically connected via a bypass pipeline 12 to the exhaust steam pipeline 6 or to the cold reheat line 9. A high-pressure bypass valve 13 is arranged in the bypass pipeline 12.

The hot reheat line 8 is fluidically interconnected with the condenser 4 via an intermediate-pressure bypass pipeline 14. An intermediate-pressure bypass valve 17 is arranged in the intermediate-pressure bypass pipeline 14. During starting, shutting down or in the case of an emergency shutdown of the steam turbine 3, the steam from the live steam pipeline 5 is directed via the bypass pipeline 12 into the cold reheat pipeline 9. For this, the emergency shut-off and control valve 10 is closed and the high-pressure bypass valve 13 is opened. Since the temperature of the live steam which flows into the bypass pipeline 12 is comparatively high, the steam is sprayed with a cooling medium 15 in a cooling unit 16 before entry into the cold reheat pipeline 9. The steam is then directed, via the reheater 7 and the hot reheat line 8 to the intermediate-pressure bypass pipeline 14, into the condenser 4. For this, the emergency shut-off and control valve 11 is closed and the intermediate-pressure bypass valve 17 is opened. Downstream of the intermediate-pressure bypass valve 17, the steam is again sprayed with a cooling medium 18 in a cooling unit 19 so that the condenser can absorb the amount of energy. Since the temperatures and the pressure of the steam are comparatively high, the live steam pipeline 5, the bypass pipeline 12, the hot reheat line 9 and the intermediate-pressure bypass pipeline 14 have to be designed for the pressure and the temperature of the reheater 7. The higher the steam temperatures are, the higher are the costs for the pipelines 5, 12, 9, 8, 1, for the valves 17, 13 and the cooling units 16 and 19.

Figure 2:
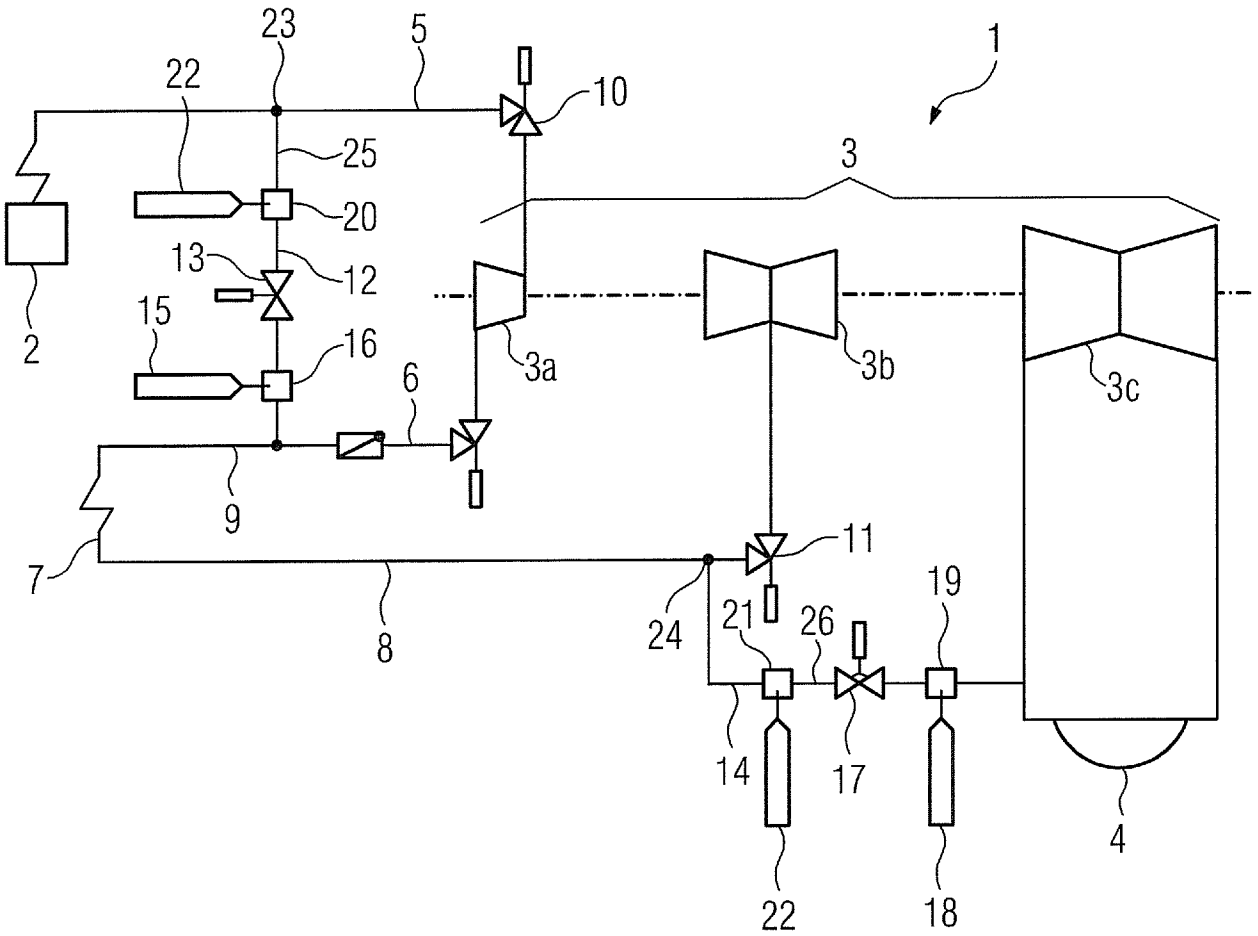
FIG. 2 shows a steam power plant according to the invention.

In FIG. 2, a steam power plant 1 according to the invention is shown. The difference to the steam power plant 1 shown in FIG. 1 is that a bypass-steam cooler 20 and an intermediate-pressure bypass-steam cooler 21 are arranged in the bypass pipeline 12 and in the intermediate-pressure bypass pipeline 14. The bypass-steam cooler 20 and the intermediate-pressure bypass-steam cooler 21 are designed for cooling steam which can flow or which is stationary and which is in the bypass pipeline 12 and in the intermediate-pressure bypass pipeline 14. By means of the bypass-steam cooler 20 and the intermediate-pressure bypass-steam cooler 21, condensate, steam or a mixture of water and steam is injected into the flowing or stationary steam. Therefore, the temperature of the flowing or stationary steam is reduced. The cooling medium 22 which is fed into the steam therefore cools the steam down. The injection of the cooling medium 22 into the bypass pipeline 12 and into the intermediate-pressure bypass pipeline 14 should be arranged as close as possible to a first branch 23 or downstream of a second branch 24. The distance between the bypass-steam cooler 20 and the high-pressure bypass valve 13 is selected in such a way that the steam is thoroughly mixed with the cooling medium 22. Similarly, the distance between the intermediate-pressure bypass-steam cooler 21 and the intermediate-pressure bypass valve 17 is selected in such a way that the steam can be thoroughly mixed with the cooling medium 22.

The cooling unit 16 or 19 may possibly be dispensed with if the live steam parameters have corresponding values. For this, the live steam mass flow, pressure and temperature, and water injection volume and temperature must have permissible values. The bypass-steam cooler 20 and the intermediate-pressure bypass-steam cooler 21 are engaged as soon as the bypass valve 13 and the intermediate-pressure bypass valve 17 are opened. As a result, an impermissible temperature excess in the cooled bypass pipeline 25 or 26 is effectively avoided.

As soon as the bypass valve 13 is closed, the bypass-steam cooler 20 is operated until the temperatures upstream of the bypass-steam cooler 20 fall below the permissible temperature in the pipelines 25. If water drains or warm-up lines are arranged in the cooled bypass pipelines 25 and 26, these have to remain closed until the temperature upstream of the bypass-steam cooler 20 and intermediate-pressure bypass-steam cooler 21 falls below the permissible temperature in the cooled pipelines 25 or 26.

The invention claimed is:

1. A steam power plant for generating electrical energy, comprising:

a steam turbine;

a steam generator;

a condenser;

a live steam pipeline which fluidically interconnects the steam turbine with the steam generator;

an exhaust steam line which fluidically interconnects the steam turbine with the condenser;

a bypass pipeline which fluidically interconnects the live steam pipeline with the exhaust steam pipeline,wherein provision is made in the bypass pipeline for a bypass-steam cooler, which is designed for cooling steam which flows in the bypass pipeline; and a high-pressure bypass valve included in the bypass pipeline, and wherein the bypass-steam cooler is arranged downstream of a first branch from the live steam pipeline on the bypass pipeline, and wherein the bypass-steam cooler is arranged between the first branch and the high-pressure bypass-valve.

2. The steam power plant as claimed in claim 1, wherein the steam turbine comprises a high-pressure turbine section, an intermediate-pressure turbine section and also a low-pressure turbine section.

3. The steam power plant as claimed in claim 2, further comprising a reheater, wherein a cold reheat pipeline fluidically interconnects a steam outlet of the high-pressure turbine section with the reheater, and wherein the bypass pipeline fluidically interconnects the live steam pipeline with the cold reheat pipeline.

4. The steam power plant as claimed in claim 2, further comprising a hot reheat pipeline which fluidically interconnects the reheater with the intermediate-pressure turbine section, wherein an intermediate-pressure bypass pipeline fluidically interconnects the hot reheat pipeline with the condenser, and wherein an intermediate-pressure bypass-steam cooler disposed in the intermediate-pressure bypass pipeline is designed for cooling steam which may flow in the intermediate-pressure bypass pipeline, wherein the intermediate-pressure bypass pipeline includes an intermediate-pressure bypass valve, and wherein the intermediate-pressure bypass-steam cooler is arranged between the reheater and the intermediate bypass-valve.

5. The steam power plant as claimed in claim 1, wherein cooling of the steam in the bypass-steam cooler is carried out by injection of a cooling media selected from the group comprising of condensate, steam or a mixture of water and steam.

6. The steam power plant as claimed in claim 4, wherein cooling of the steam in the intermediate-pressure bypass-steam cooler is carried out by injection of cooling media selected from the group comprising of condensate, steam or a mixture of water and steam.

7. The steam power plant as claimed in claim 4, wherein the intermediate-pressure bypass-steam cooler is arranged directly downstream of a second branch from the hot reheat pipeline to the intermediate-pressure bypass pipeline.

8. The steam power plant as claimed in claim 4, wherein a distance between the bypass-steam cooler and the high-pressure bypass valve is selected in such a way that the cooling medium may be thoroughly mixed with the steam.

9. The steam power plant as claimed in claim 4, wherein a distance between the intermediate-pressure bypass-steam cooler and the intermediate-pressure bypass valve is selected in such a way that the cooling medium may be thoroughly mixed with the steam.

* * * * *